US005859438A

United States Patent [19]

Nemezawa et al.

[11] Patent Number: 5,859,438

[45] Date of Patent: Jan. 12, 1999

[54] RADIATION SHIELDING BODY

[75] Inventors: Isao Nemezawa; Tadahiro Kimura; Akira Mizuochi; Tetsu Oomori, all of Hitachi, Japan

[73] Assignees: Hitachi, Ltd., Tokyo; Hitachi Engineering & Services Co. Ltd., Ibaraki, both of Japan

[21] Appl. No.: 912,343

[22] Filed: Aug. 18, 1997

[30] Foreign Application Priority Data

Aug. 28, 1996 [JP] Japan ..... 8-226366

[51] Int. Cl.[6] ..... G21F 3/00

[52] U.S. Cl. ..... 250/519.1

[58] Field of Search ..... 250/519.1, 515.1; 428/72, 74, 77, 35.2; 160/351; 376/287, 260

[56] References Cited

U.S. PATENT DOCUMENTS

| | | | |
|---|---|---|---|
| 4,454,905 | 6/1984 | Banko, Jr. | 250/515.1 |
| 4,619,852 | 10/1986 | Mio et al. | 250/519.1 |

FOREIGN PATENT DOCUMENTS

| | | |
|---|---|---|
| 59-12398 | 1/1984 | Japan . |
| 61-147998 | 9/1986 | Japan . |
| 6-230178 | 8/1994 | Japan . |
| 7-084091 | 3/1995 | Japan . |
| 8-211192 | 8/1996 | Japan . |

*Primary Examiner*—Kiet T. Nguyen
*Attorney, Agent, or Firm*—Fay, Sharpe. Beall, Fagan, Minnich & McKee

[57] ABSTRACT

A radiation shielding body unit comprises a bag, a reinforcing wall connecting between inner wall surfaces of the bag opposite to each other, a liquid supply/discharge port for radiation shielding liquid, provided in the bag, and a hole portion provided in the bag for engagement with a connection device used when the bag is supported by suspension. And a radiation shielding body comprises a frame and a plurality of the above-mentioned radiation shielding body units, each of the radiation shielding body units is suspendedly supported by the frame through a connecting device engaged with the hole portion of each of the radiation shielding body units.

19 Claims, 11 Drawing Sheets

RADIATION SHIELDING BODY

BACKGROUND OF THE INVENTION

The present invention relates to a radiation shielding body used for protecting a worker or workers in radiation environments from radiation exposure.

In a case where any work is carried out in radiation environments, a radiation shielding body is used as a means for protecting a worker attending to the work.

An example of the radiation shielding body is proposed in Japanese Utility-model Laid-open Application 61-147998. The proposed radiation shielding body has a bag of synthetic resin, which has a radiation shielding liquid such as water, sodium borate, etc. injected therein and is arranged to cover piping having therein radioactive substances, and shields radiation with the radiation shielding liquid. In this proposed example, a plurality of the bags are connected to each other by fasteners at the outer periphery of the piping containing therein radioactive substances, and the connected bags are wound around the outer periphery of the piping and used. Therefore, the piping supports the plurality of bags and the radiation shielding liquid.

In radiation shielding work that winds a radiation shielding body around piping and devices having therein radioactive substances and covers them therewith, since a worker attending to the work must approach the piping and devices, the worker is in danger of being exposed to radiation.

In a case where the piping and devices are covered with thermal insulating material, since work for removing the thermal insulating material is carried out before winding the radiation shielding body around the piping and devices, a worker attending to the removal of the thermal insulating material also is in danger because the dose of radiation to which the worker is exposed increases.

In a case where the method of winding the radiation insulating body around the piping and devices and covering them with the radiation insulating body is taken, when the piping and devices have complicated shapes as in piping provided with pipe rests and valves thereon or elbow portions and T-shaped branch portions of piping, it is difficult and takes much working time to wind the radiation shielding body around that portion, whereby there occurs a danger that the radiation exposure dose to a worker attending to the work for winding the radiation shielding body around that portion increases.

Further, a radiation shielding body that a radiation shielding liquid such as water is enclosed inside a container made of resin or metal is known in JP A 59-12398, JP A 8-211192, JP A 6-230178.

In those prior arts, since the container containing therein liquid such as water as a radiation shielding liquid stands upright by itself and is arranged on a floor, it is difficult to set it on a portion made narrow by obstacles disposed on the floor.

Further, since the container has water inside, it is difficult to make the height tall and shield radiation in a vertically wide region by one container.

In order to increase a vertical region covered by one radiation shielding body and make it possible to use it for radiation shielding in a narrow portion, a radiation shielding body, which is made of a lead plate or lead hair worked in a thin and wide mat-like shape and which is hung for use or stood between radioactive devices and a worker, is disclosed in JP A 7-84091.

However, the radiation shielding body formed of the lead plate or lead hair worked in a mat-like shape has a much heavier specific weight than radiation shielding liquid, and when radiation shielding is effected over a wide range, its weight becomes larger and its handling such as mounting, removing and transferring it is not easy. Therefore, there occurs a danger that the worker attending to the work could receive a large dose of radiation exposure during the handling of the radiation shielding body in a radiation environment.

SUMMARY OF THE INVENTION

Therefore, an object of the invention is to provide a radiation shielding body which is good at handling and able to reduce a dose of radiation exposed to a worker attending to an installation, removing and transferring of the radiation shielding body.

The present invention set forth in claim 1 resides in a radiation shielding body unit comprising a bag, a reinforcing wall connecting between inner wall surfaces of the bag opposite to each other, a liquid supply/discharge port for radiation shielding liquid provided in the bag, and a hole portion for engagement with a connection means used when the bag is supported by suspension. The radiation shielding body is made in a vertical attitude by inserting the connecting means into the hole portion to be suspended under the condition that the radiation shielding liquid is accommodated from the liquid supply/discharge port, thereby to distribute the radiation shielding liquid widely over the vertical surfaces, and radiation is shielded by the radiation shielding liquid widely vertically distributed inside the bag. Further, the bag can be made compact under the condition of no radiation shielding liquid in the bag, and the bag and the radiation shielding liquid can be treated independently by supplying or discharging the radiation shielding liquid from the hole portion, so that such an effect can be attained that handling such as the work of supporting by suspension the bag, the work of transferring it, etc. is easy.

The present invention set forth in claim 14 resides in a radiation shielding body comprising a frame provided with horizontal frames mounted on a support column set upright in at least two stages, upper and lower, connecting means provided on each of the horizontal frames at a horizontal distance therebetween, a plurality of bags each containing therein radiation shielding liquid, having inner surfaces opposite to each other and reinforced by a reinforcing wall, and detachably supported by suspension by the connecting means, a liquid supply/discharge port for the radiation shielding liquid provided in each of the bags, a radiation shielding plate of metal supported by the support column and arranged at a level of a vertical gap or spacing between the bags arranged up and down. The plurality of bags are arranged on a perpendicular surface, the radiation shielding liquid inside the bags is distributed in a vertically wide range, the radiation shielding liquid performs an operation of preventing radiation from penetrating, whereby a large vertical radiation shielding surface can be secured. Further, since the widely distributed radiation shielding liquid is divided into the plurality of bags, it is easy to maintain a desired thickness of the radiation shielding liquid layer in the perpendicular plane by reinforcing the bags with the reinforcing wall. Since individual bags are separated from each other, handling individually the individual bags is easy and a vertically wide radiation shielding surface can be easily secured. Still further, the radiation shielding plate shields radiation directed to the gap between the upper and lower bags and contributes to sure radiation shielding, so that radiation shielding of a vertically wide surface can be easily and surely effected.

DESCRIPTION OF PREFERRED EMBODIMENTS

Figure 1A:
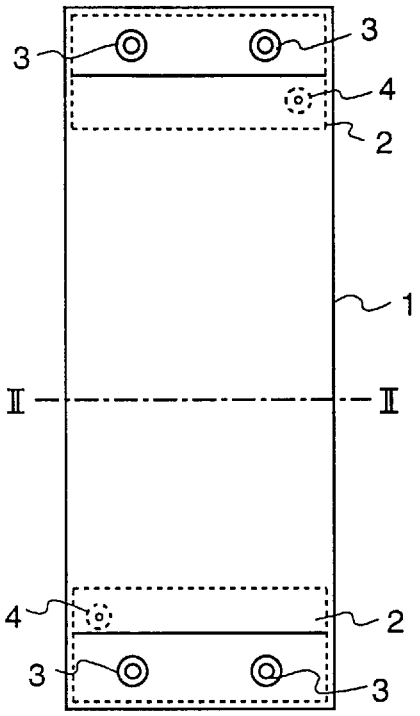
FIG. 1A is a front view of a bag of a radiation shielding body of an embodiment of the present invention.
Figure 1B:
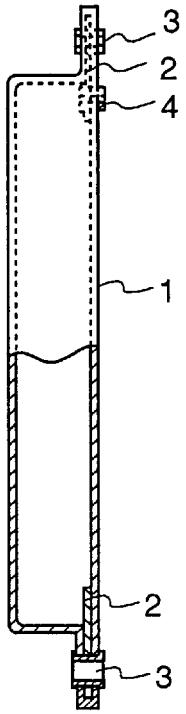
FIG. 1B is a right side view sectioned in part of FIG. 1A.
Figure 1C:
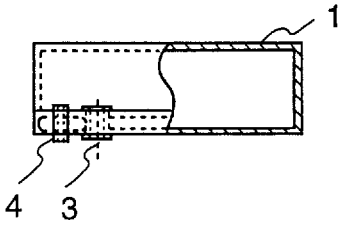
FIG. 1C is a bottom view sectioned in part of FIG. 1A.

As shown in FIGS. 1A to 1C, upper and lower portions of a bag 1 made by melt-bonding or gluing poly-urethane sheets sandwich metal plates 2 and are flattened. The metal plates 2 and the upper and lower portions are melt-bonded or glued to form regions in each of which water is not contained.

Eyelet metal fasteners 3, which are annular hollow members of metal, are passed through the flat portions of the bag 1 in the upper and lower portion of the bag 1 and mounted thereon. The number of the eyelet metal fasteners 3 mounted on the bag 1 are two at a horizontal distance therebetween in the upper portion of the bag 1 and, similarly, two at a horizontal distance therebetween in the lower portion, as shown in FIG. 1A.

The bag 1 has supply/discharge ports 4 provided in the upper and lower positions, respectively, as shown in FIGS. 1A to 1C.

In order to increase the mounting strength of the supply/discharge ports 4 and the strength around the supply/discharge ports 4 by the metal plates 2, the supply/discharge ports 4 each are provided within a vertical range of the presence of the metal plate 2. Those supply/discharge ports 4 each are used for water supply into the bag 1 and water discharge out of the bag 1, have a construction that a hose for water supply and water discharge can be connected with, and a construction that the water supply/discharge port 4 is automatically opened when the hose is connected to the water supply/discharge port 4 and automatically closed when the hose is disconnected from the water supply discharge port 4.

Opening and closing of the water supply/discharge ports 4 also can be performed by pulling out plugs strictly inserted in the water supply/discharge ports 4 and inserting them in the water supply/discharge ports 4. In this case, since the work of inserting and pulling out the plugs is necessary, in addition to the work of connection and disconnection of the hoses into and from the water supply/discharge ports 4, time is taken for connection and disconnection of the hoses to and from the water supply/discharge ports and the effect of reducing radiation exposure decreases.

Figure 2:
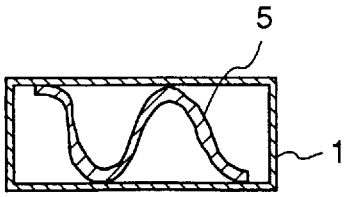
FIG. 2 is a sectional view of FIG. 1A taken along a line II—II, in a case where a reinforcing wall is contained in the bag of FIGS. 1A to 1C.

The bag 1 has a reinforcing wall 5 mounted inside, which is melt-bonded or glued on the inner wall surfaces of the bag 1. The reinforcing wall 5 can have a continuously curved shape as shown in FIG. 2, or a sectional shape as shown in FIGS. 10, 11, 12 and 13.

Figure 14:
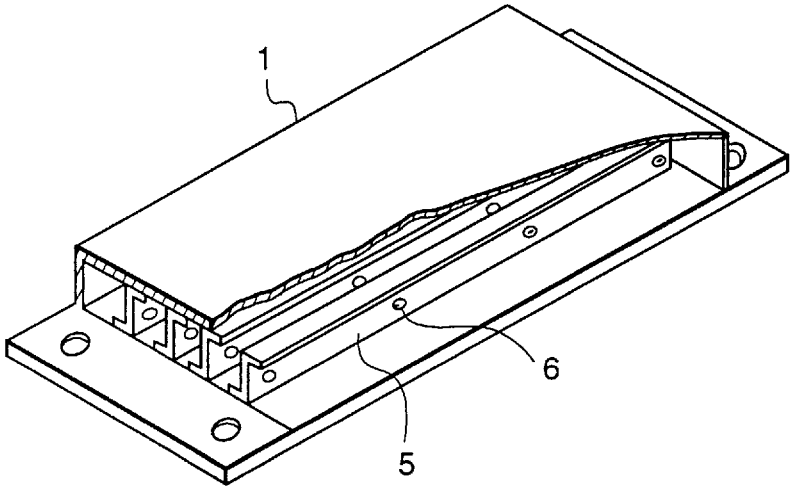
FIG. 14 is a perspective view sectioned in part of a bag which has the reinforcing walls of FIG. 10 mounted inside.

Any of the reinforcing walls also are arranged inside the bag 1 to be long in a vertical direction as shown in FIG. 14, and partitions the inside of the bag 1 into a plurality of cells. Flow holes 6 through which radiation shielding liquid is able to pass are opened in the reinforcing wall or walls 5 at various positions thereof in order to fill the plurality of cells with the radiation shielding liquid.

Those bags 1 are used as a means for shielding radiation so that a worker attending to maintenance and inspection under radiation environmental conditions in a nuclear power plant, for example, is not exposed to radiation.

Concretely, they are used as follows:

First of all, a frame 7 is horizontally installed covering a place to be shielded of radiation, in a building which is provided with piping and devices emitting radiation.

Figure 3:
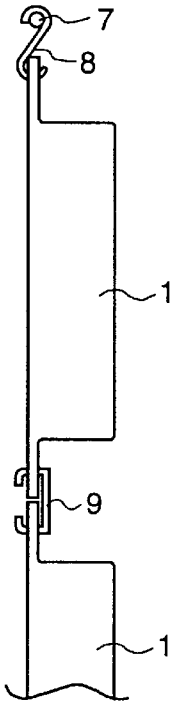
FIG. 3 is an elevation view of the bag of FIGS. 1A to 1C, showing a suspension supporting state.

The frame 7 is a horizontal beam standing by itself on the floor or supported by a support supported from the ceiling. From the frame 7, the bags 1 are hung by S-letter hook-shaped connectors 8, each having an upper portion hooked on the frame 7 and a lower portion inserted in the eyelet metal fastener 3 of the bag 1, as shown in FIG. 3. Thereby, the bag 1 is suspended from and supported by the frame 7, using the S-letter hooks as the connecting device 8.

Intermediate connectors 9 each have hooks at upper and lower portions. The upper portion of each intermediate connector 9 is hooked in the eyelet metal fastener 3 of the lower portion of the bag 1. The lower portion of each intermediate connector 9 is inserted in an eyelet metal fastener 3 provided in an upper portion of a lower bag 1.

In this manner, a plurality of the bags 1 which are vertically connected in series to have a height necessary to shield radiation, and suspended from and supported by the frame 7 are arranged for radiation shielding.

Figure 4:
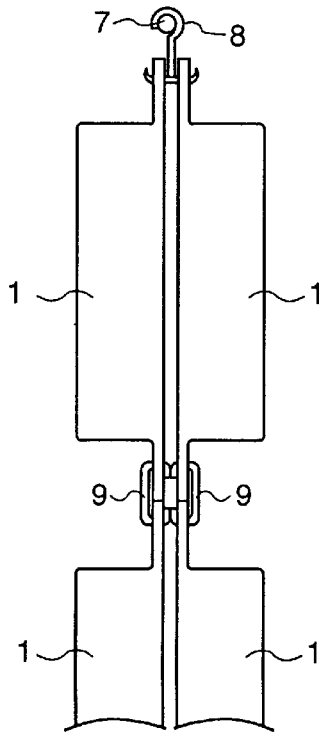
FIG. 4 is an elevation view of the bag of FIGS. 1A to 1C, showing a double-bag suspension supporting state.

In a case where radiation to be shielded is strong, a plurality of bags 1 are arranged so as to horizontally overlap, and suspended and supported as shown in FIG. 4.

As shown in FIG. 4, connectors 8 hung on the frame 7 each have a round hook-shaped upper portion and a double-hook shaped lower portion with hooks on the right and left. The upper portion of the connector 8 is hooked on the frame 7, and the lower double-hook shaped portion is inserted into eyelet metal fasteners 3 of the bags 1. The support condition is the same as in right and left bags 1.

With this construction, the upper bag 1 is suspended from and supported by the frame 7, using the connecting devices 8. The lower bag 1 is connected to the lower portion of the upper bag 1 with the intermediate connecting device 9 in the same manner as in FIG. 3, thereby being suspended and supported.

A hose which is connected to a feed water pump is connected to the supply/discharge port 4 at the lower portion of each of the bags 1 suspension-supported in the above-mentioned manner, and water stored in a water tank is supplied as radiation shielding liquid into each of the bags 1 through the hose by the feed pump. As each bag 1 is supplied with water to raise a water level thereof, gas in the bag 1 is discharged from the supply/discharge port 4 in the upper portion of each bag 1.

In order to make it possible to exhaust, a hose is provided of which one end is connected to the upper supply/discharge port 4 of each bag 1 and the other end is opened inside the building, whereby the upper supply/discharge port is opened inside the building. Therefore, the gas inside the bag 1 is exhausted from the upper supply/discharge port 4 in the building through the hose connected to the upper supply/discharge port 4.

After each bag 1 is sufficiently supplied with water, each hose is disconnected from the supply/discharge port 4, the water in each bag 1 shields radiation from a worker in a region which is in shadow of the bag 1 against radiation being emitted from piping and devices.

Under the condition that water entered each bag 1 in this manner, force expanding the bag 1 by the weight of the water acts on the lower portion of the bag 1, but the reinforcing wall 5 connects the opposite inner wall surfaces in the bag 1 and prevents deformation of the bag 1 which otherwise may be caused by the force expanding the bag 1.

Therefore, deformation of the bag 1 is a little. The thickness of a water layer in a horizontal direction becomes approximately uniform along a vertical direction. Therefore, radiation is uniformly shielded by water inside the bag 1 and variation in shielding occurs to a minute degree.

Under the condition that each bag 1 is suspension supported as shown in FIG. 3 or FIG. 4, a region in which water does not exist is generated at an upper portion of the upper bag 1 and in the vicinity of a joint portion of the upper and lower bags 1, however, radiation to that region is shielded by the metal plate 2, whereby penetration of radiation is minimized therein.

In particular, in a radiation shielding body in which a plurality of bags 1 are lapped in a horizontal direction and suspension-supported as shown in FIG. 4, horizontal thickness of a water layer contributed to radiation shielding is increased twice, so that the radiation shielding body has a strong radiation shielding function.

When each bag 1 is supplied with water, if a hose connected to a feed water pump is connected to the lower supply/discharge port 4 of the lower bag 1, the upper supply/discharge port 4 of the lower bag 1 and the lower supply/discharge port 4 of the upper bag 1 are connected by a hose, and a hose for gas discharge is connected to the upper supply/discharge port 4 of the upper bag 1, water supplied by the feed water pump enters the lower bag 1 and then the upper bag 1, so that handling labor for connecting of the hose connected to the feed water pump to each bag 1 is decreased.

While a worker is working, since each bag contains water poured thereinto, a large load concentrates on portions of the bag 1 which are hung by the connecting device 8 and intermediate connecting device 9 and the bag 1 is easy to be broken, however, the metal plate 2 carries out the role to raise the strength as a reinforcing plate and suppresses the breakage.

After the worker finishes the work, hoses are connected to the bag 1 in a similar condition to water supply, the hose is disengaged from the feed water pump to discharge water by flowing water in a reverse direction to the condition that the water enters the bag 1, and gas is introduced into the bag 1 through the hose for exhaust gas.

Since the bag 1 becomes light in weight after water in the bag 1 is discharged from the supply/discharge port 4, the work of disconnecting the bags 1 from the frame 7 and cleaning becomes easy.

Since the bag 1 is light in weight, its handling is easy and it is suppressed that a radiation exposure dose of a worker handling the bags 1 becomes large by taking more time to handle the bags 1 in a radioactive environment.

A structural member of the building can be the frame 7 if it is able to bear the weight of the bags 1 therein containing water, for example, a handrail of a stairway installed in the building can be used as the frame 7. In a case where the handrail is used as the frame 7, the bags 1 are hung from the handrail and able to protect a worker using the stairway from radiation.

Figure 16:
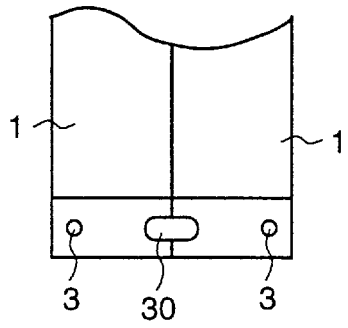
FIG. 16 is a front view showing a connecting condition of adjacent bags, according to an embodiment of the invention.
Figure 17:
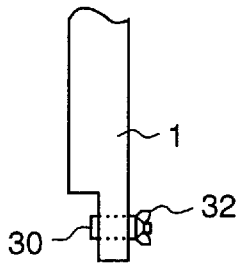
FIG. 17 is a right side view of FIG. 16.
Figure 18:
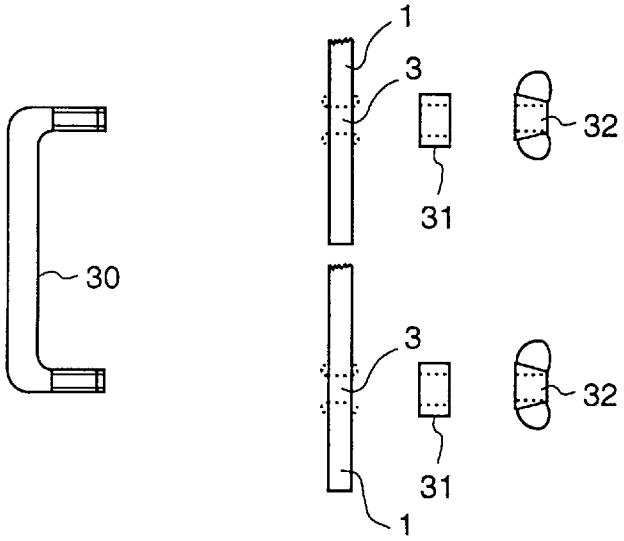
FIG. 18 is a view showing a disassembled condition of connecting means shown in FIG. 16.

Since the lower ends of the bags 1 suspension supported from the frame 7 are not fixed, there is such concern that the lower ends move by external force, as a result, gaps occur between adjacent bags 1 and radiation leaks from the gaps. In order to remove the concern, a U-letter shaped bolt 30 as shown in FIG. 18 is inserted in the eyelet metal fasteners 3 of the adjacent bags 1, as shown in FIGS. 16 and 17, and a collar 31 fitted to the bolt ends from the opposite side and butterfly nuts are screwed on the threaded portions of the bolt ends to fasten, thereby minimizing the occurrence of gaps between the adjacent bags 1.

Figure 5A:
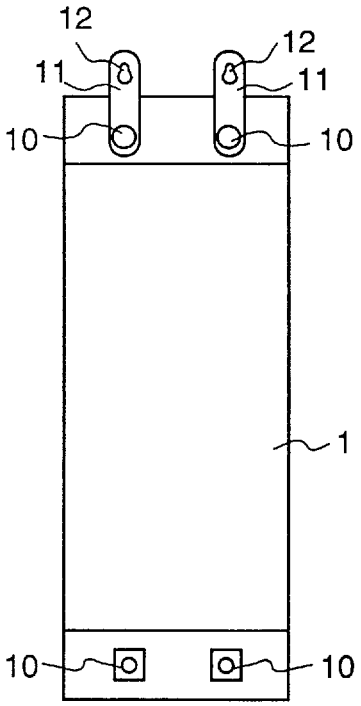
FIG. 5A is a front view of the bag in FIGS. 1A to 1C, wherein other connecting devices are employed for the bag of FIGS. 1A to 1C.
Figure 5B:
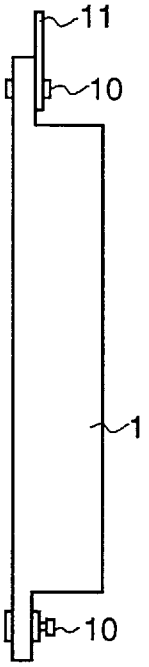
FIG. 5B is a side view of FIG. 5A.

The bag 1 shown in FIGS. 5A and 5B is one made by modifying a part of the bag 1 shown in FIG. 1, and part of each of the eyelet metal fasteners 3 of the bag 1 is modified. Concretely, the eyelet metal fasteners 3 are not used and connecting metal devices 10 are fixed at the position of the fasteners 3 no longer used.

The connecting metal devices 10 each have a bolt head shape at a specific location projected right in FIG. 5B. Each connecting metal device 10 at an upper portion of the bag 1 is connected to a hanging device 11. The hanging device 11 has an opening 12 consisting of a larger diameter opening part at a lower portion and a smaller diameter opening part at an upper portion. The larger diameter opening part has a size such that the head portion of the connecting metal device 10 can pass through, and the smaller diameter opening part has a size such that the head portion can not pass through and a smaller diameter portion of the connecting metal device 10 adjacent to the head portion can pass through.

The other construction is the same as one of the bag 1 shown in FIGS. 1A to 1C.

The bag 1 shown in FIGS. 5A and 5B is used in the following manner.

Figure 6:
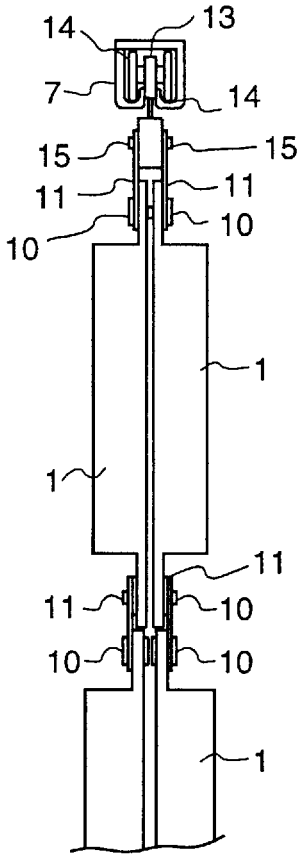
FIG. 6 is an elevation view of bags, showing a state that the bag of FIG. 5 is supported by suspension.
Figure 7:
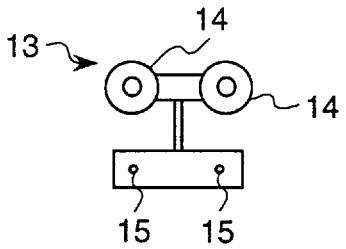
FIG. 7 is a side view of a slider shown in FIG. 6.
Figure 8:
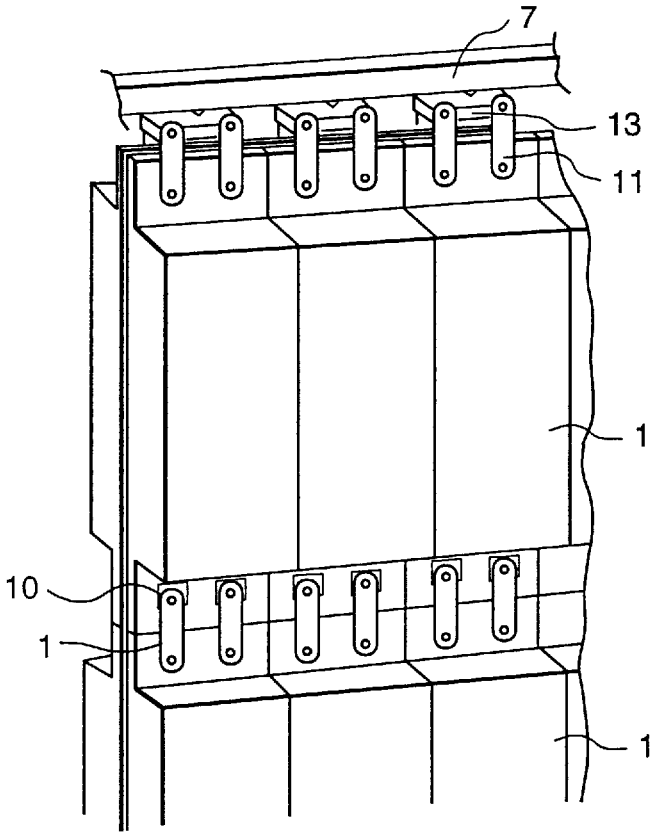
FIG. 8 is a perspective view of the bags each shown in FIG. 6, showing a suspension supporting state.

That is, the hollow frame 7 as shown in FIG. 6 is supported horizontally by support columns standing on the floor of the building or from the ceiling of a room of the building. A carriage 13 with wheels 14 as shown in FIG. 7 is accommodated in the frame 7 so as to be travelable. A plurality of the carriages 13 are installed on the frame 7 as shown in FIG. 8. The carriages 13 each have a member suspension-supported therefrom, which member has horizontal projections 15 which are able to hang the hanging devices 11 of the bag 1, as shown in FIG. 7.

The horizontal projections 15 are inserted in the openings 12 of the hanging metal devices 11 to hang the bag 1, and the upper bag 1 is suspended from and supported by the frame 7 through the carriage 13.

The opening portion of the hanging metal device 11 of the lower bag 1 is engaged with the connecting metal device 10 at the lower portion of the upper bag 1 to be hung, whereby the lower bag 1 is suspension-supported by the lower portion of the upper bag 1.

The upper and lower bags 1 are arranged in two rows, right and left, as shown in FIG. 6, and a plurality of bags 1 are arranged in the length direction of the frame 7 according to the number of the carriages. This installation of the bags 1 on the frame 7 is effected in a place in which radiation is not easily exposed.

After the bags 1 are suspended from and supported by the frame 7 through the carriages 13, the carriages 13 are travelled along the frame 7 to move the bags 1 to a radiation shielding position. Then, water is supplied to each bag 1 for radiation shielding. A method of supplying water into each bag 1 is the same as the method of supplying water into the bags 1 in FIGS. 1A to 1C.

After radiation shielding has been unnecessary, water is discharged from each bag 1 in the same manner as the water discharge of the bag 1 in FIGS. 1A to 1C, the carriages 13 are travelled along the frame 7 to move the bags 1 to a storage position of the bags 1.

Further, it is possible to move the bags 1 to the radiation shielding position after the bags 1 are supplied with water, or it is possible to move the bags 1 containing water to the bag storage position. In any case, the bags 1 are moved easily and rapidly by the running of the carriages 13.

In this manner, in a system in which the bags 1 are suspended from and supported by the frame 7 through the carriages 13, it is possible to easily change the radiation shielding position by moving the bags 1 along the frame 7.

Since the plurality of carriages 13 are not connected to one another, movement of adjacent carriages 13 so as to be separated from each other is able to make such a space between the adjacent bags 1 supported by the adjacent carriages 13 that a worker is able to pass through.

Although the bags 1 are necessary to be moved for making space for passage of a person, and the movement is able to be easily done with small force by moving the carriages 13 supporting the bags 1 along the frame 7.

The space is provided at a position nearest to a working object, whereby a worker can access the working object, passing through the space at the shortest distance from the working object. After working, the worker can return to the radiation shielding region through the space, by passage of the shortest distance. Therefore, radiation exposure to the worker can be suppressed.

Figure 9:
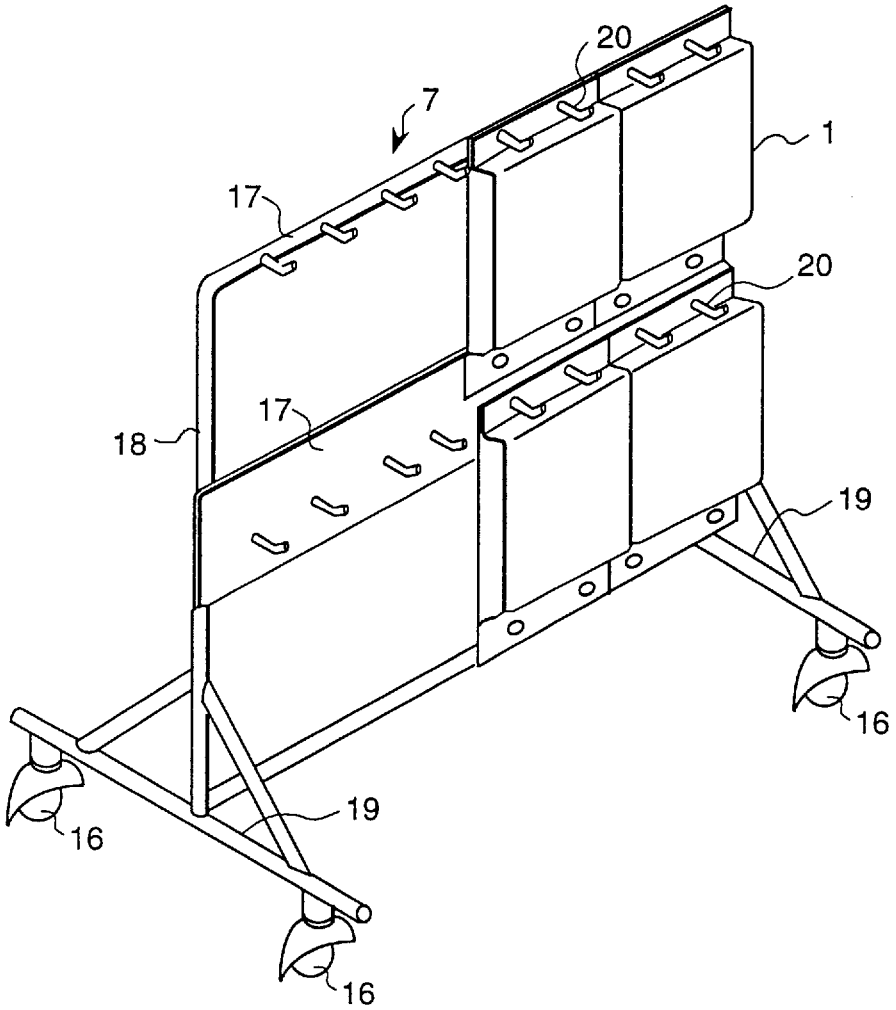
FIG. 9 is a perspective view of a frame which is able to suspension-support a plurality of bags in FIGS. 1A to 1C on right and left sides and up and down sides.
Figure 10:
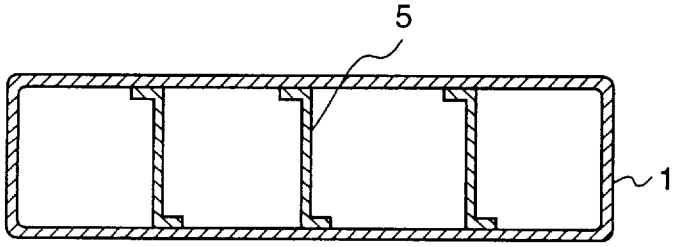
FIG. 10 is a sectional view of another embodiment of reinforcing walls mounted inside the bag of FIGS. 1A to 1C.
Figure 11:
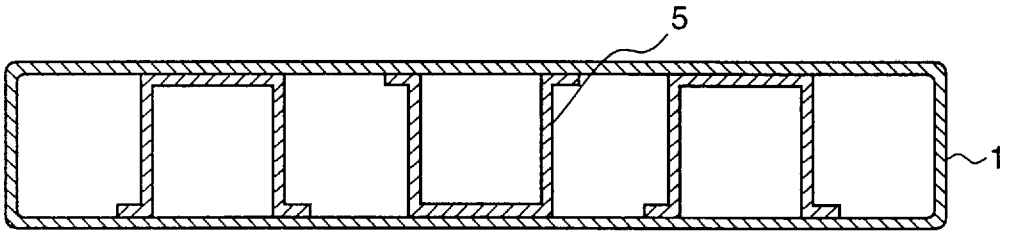
FIG. 11 is a sectional view of another embodiment of reinforcing walls mounted inside the bag of FIGS. 1A to 1C.
Figure 12:
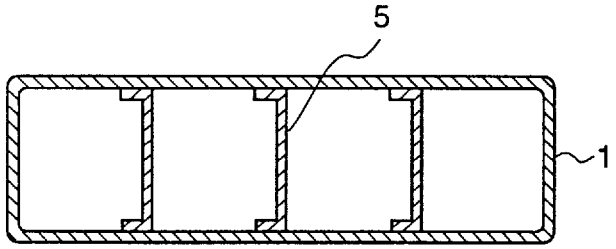
FIG. 12 is a sectional view of further another embodiment of reinforcing walls mounted inside the bag of FIGS. 1A to 1C.
Figure 13:
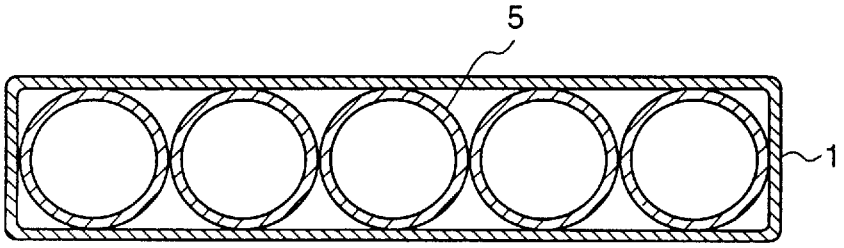
FIG. 13 is a sectional view of further another embodiment of reinforcing walls mounted inside the bag of FIGS. 1A to 1C.

An embodiment shown in FIG. 9 uses the bags 1 of FIGS. 1A to 1C, and the construction of each of the bags 1 is the same as in FIGS. 1A to 1C.

In FIG. 9, the frame 7 suspension-supporting bags 1 is supported by casters 16 each having a function of horizontally revolving.

The concrete construction of the frame 7 is as shown in FIG. 9. Two: upper and lower horizontal frames 17 are supported by support columns 18 to be horizontal, and the support columns 18 are fixed to carriage frames 19 with the casters 16 to be vertical. Each of the horizontal frames 17 made of metal has a plurality of hooks 20 mounted thereon at the same horizontal intervals as ones of the eyelet metal fasteners 3 of the bags 1.

When the bags 1 are mounted on the frame 7, the upper eyelet metal fasteners 3 of the upper bags 1 are hooked on the hooks 20 of the upper horizontal frame 17 so that the bags 1 are suspended and supported as shown in FIG. 9. In the similar manner, the upper eyelet metal fasteners 3 of the lower bags 1 are hooked on the hooks 20 of the lower horizontal frame 17. The bags 1 are arranged on the frame 7 in plural stages in a vertical direction and in plurality of rows in a horizontal direction.

In this manner, the bags 1 are hooked on all the hooks of the frame 7.

The installation of the bags 1 on the frame 7 is effected in a place where radiation is not easily exposed. Then, the frame 7 is moved to a radiation shielding position by pushing the carriage frames 19 or the like manner through rotation of the casters 16.

The casters 16 are freely revolvable on a horizontal plane, so that the frame 7 can be freely moved on the floor in horizontal two-dimensional directions.

After that, each bag 1 is supplied with water to be served as radiation shielding. The water supply method is the same as previously described.

After each bag 1 is supplied with water, the water in the bags 1 carries out a function of shielding radiation, however, metal plates 2 mounted on the bags 1 and the lower horizontal frame 17 perform the radiation shielding function in the vicinity of the eyelet metal fasteners 3 around which water does not reach.

In order to sufficiently perform the function, the lower horizontal frame 17 has a wider width in the vertical direction than that of the upper horizontal frame 17, and the lower horizontal frame 17 is overlapped with the lower end portions of the upper bags 1 and the upper end portions of the lower bags 1.

Therefore, if each bag 1 is not broken when each bag 1 is hung on the hooks 20, it is possible to omit provision of the metal plates 2 since the lower horizontal frame 17 shields radiation.

After the radiation shielding has become unnecessary, water is discharged from each bag 1 in the previously described manner.

Then, the frame 7 on which the bags 1 hangs is moved to return to an original position. This movement is effected by every frame 7 hanging a plurality of the bags 1, using the casters 16, so that the movement is easy and rapid.

Water supply to the bags 1 and water discharge from the bags 1 are effected in a place where radiation is not easily exposed, it is possible to transfer the bags 1 or the frame 7 under the condition that the water is contained in the bags 1. In this case also, the casters 16 are effective as means for moving easily and rapidly.

The height of the upper frame 17 is 2 m or more from the floor on which the casters move, however, since the bags 1 are made of urethane sheet in many cases and light in weight, the working of hooking the bags 1 on the hooks is performed safely and easily.

Figure 15:
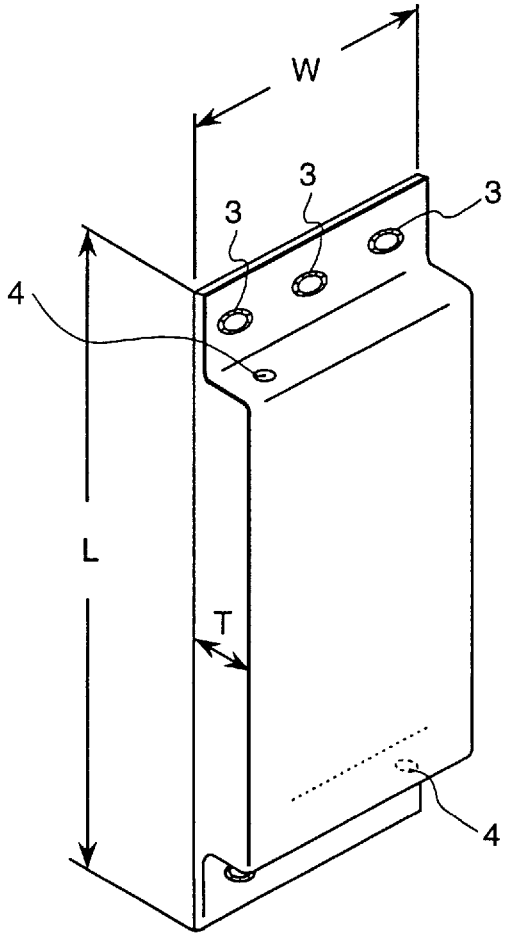
FIG. 15 is a perspective view of a bag in a case where the position of supply/discharge ports of the bag of FIGS. 1A to 1C is changed.

In any of the previously described embodiments, in a case where it is desired to sufficiently fill the bag 1 with water, it is preferable to lay the bag 1 in an attitude at which the bag 1 is used for radiation shielding as shown in FIG. 15, and to provide the upper supply/discharge port 4 on the surface of the bag 1 oriented upward.

In a case where it is desired to sufficiently discharge water from the bag 1, it is preferable to lay the bag 1 in an attitude at which the bag 1 is used for radiation shielding as shown in FIG. 15, and to provide the lower supply/discharge port 4 on the surface of the bag 1 oriented downward.

Further, in order to disperse the load supporting the bag 1, two eyelet metal fasteners 3 in each of the upper and lower portions are used, however, the number of the eyelet metal fasteners 3 can be increased to three in each of the upper and lower portions, as in FIG. 15.

As for the size of the bag 1, it is preferable that the full length L in a vertical direction, the width W and thickness T are about 1 m, about 36 cm and about 5 cm, respectively, in the attitude at which the bag 1 is used for radiation shielding, whereby the weight of each bag 1 is made light and its handling improved. The weight of the bag 1 filled with water is about 17 kg.

In a case where such a bag 1 is broken, the bag 1, the bag is burnt as waste. When the bag 1 has many unburnable members such as the metal plates 2, it is feared that the treatment of the waste will take much time. Further, since the weight of the bag 1 due to increase of the metal plates 2 increases, it is necessary to take into consideration reduction of a quantity of water in the bag by an amount of water corresponding to the increase in the metal plates.

In order to effect burning treatment and weight reduction, the following embodiment can be provided.

That is, in this embodiment, the previously described bag 1 is improved. The improvement is in that the metal plates 2 presented around the eyelet metal fasteners 3 are omitted and the urethane sheet forming the bag 1 is folded two around the eyelet metal fasteners and glued or melt-bonded instead of the metal plates 2 to reinforce, as shown in FIG. 19.

The eyelet metal fasteners 3 are provided on the two-fold portions.

Figure 19A:
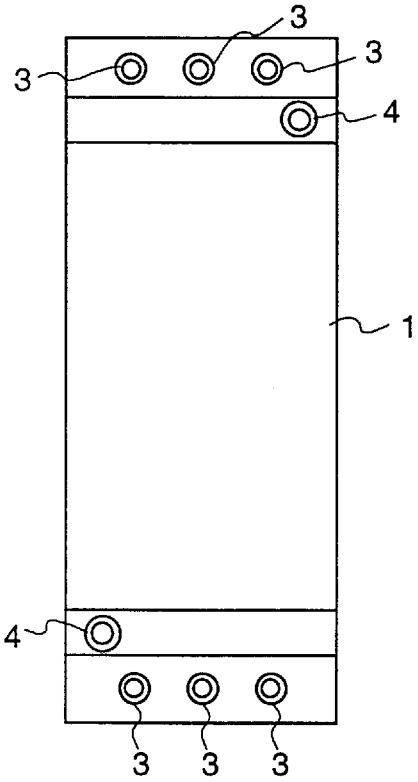
FIG. 19A is a front view of a bag of a radiation shielding body of another embodiment of the present invention.
Figure 19B:
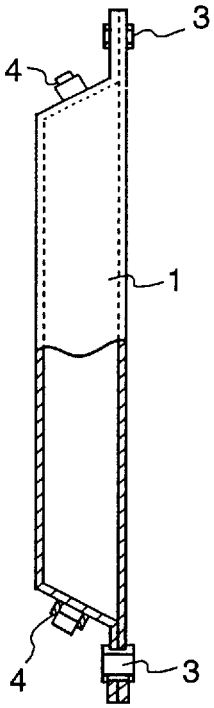
FIG. 19B is a right side view sectioned in part of FIG. 1A.
Figure 19C:
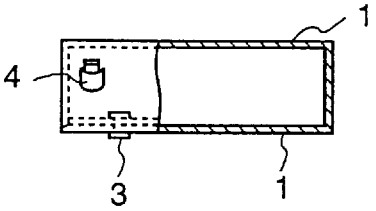
FIG. 19C is a bottom view sectioned in part of FIG. 19A.

The bag 1 shown in FIG. 19 can have any reinforcing wall 5 as shown in FIGS. 10 to 14.

The other construction of the bag 1 shown in FIG. 19 is the same as one of the bag 1 described in the other embodiments.

Since the bag 1 shown in FIG. 19 does not use the function that the metal plate 2 reinforces around the eyelet metal fastener, when the bag 1 with the number of the eyelet metal fasteners 3 being increased is suspension-supported, the weight of the bag with water itself is dispersed into three points at which the bag 1 is suspension-supported.

Figure 20:
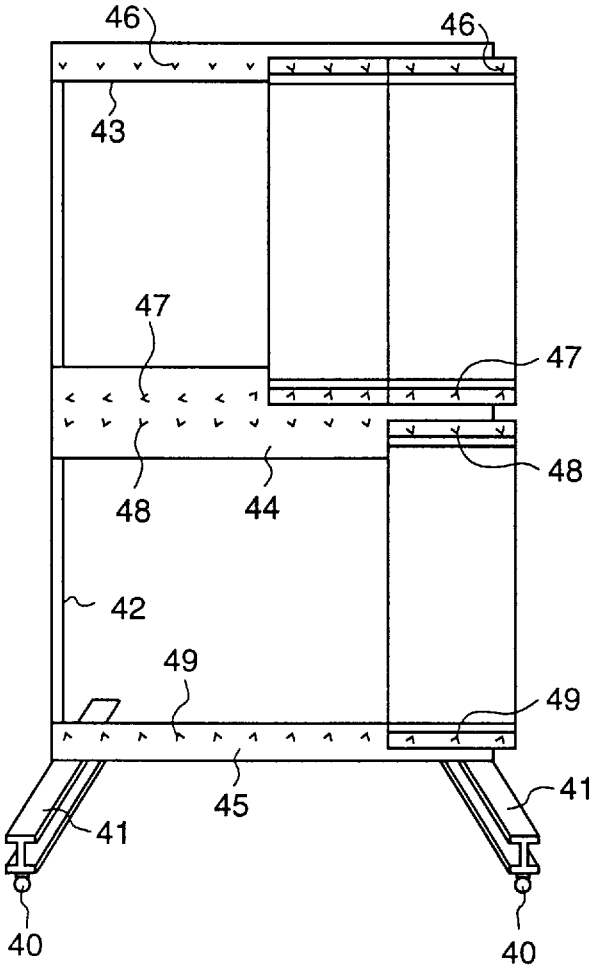
FIG. 20 is a view showing a condition where the bags of FIG. 19 are installed on a frame.

The bag 1 shown in FIG. 19 is used as shown in FIG. 20. That is, the frame 7 is used for suspension-supporting the bag 1.

In the construction of the frame 7 as shown in FIG. 20, support columns 42 are fixed to movable carriage frames 41 with casters 40, and three horizontal frames 43, 44, 45, upper, intermediate and lower, of metal are arranged in a vertical direction and fixed to the support columns 42.

The upper horizontal frame 43 has upward-oriented hooks 46 fixed thereto at the same intervals as those of the eyelet metal fasteners 3. The intermediate horizontal frame 44 has downward-oriented hooks 47 and upward-oriented hooks 48 separated from each other in the up and down hook groups and horizontally spaced from each other in each hook group at the same intervals as those of the eyelet metal fasteners. The lower horizontal frame 45 has downward-oriented hooks 49 fixed thereto at the same intervals as those of the eyelet metal fasteners 3.

The upper eyelet metal fasteners 3 of the bag 1 of FIG. 19 are hooked on the hooks 46, and the lower eyelet metal fasteners 3 of the bag 1 are hooked on the hooks 47. The bags 1 hooked on the hooks are horizontally arranged in plural rows.

The upper eyelet metal fasteners 3 of the bag 1 of FIG. 19 are hooked on the hooks 48, and the lower eyelet metal fasteners 3 of the bag 1 are hooked on the hooks 49. The bags 1 hooked on the hooks are horizontally arranged in plural rows.

Therefore, a plurality of the bags 1 are arranged in the up-down and left-right directions, and suspension-supported.

The time at which the bags 1 are hooked on the hooks may be after moving the frame 7 to the radiation shielding position or it can be done at a place of weak radiation intensity before moving of the bags 1 to the radiation shielding position.

Then, the bags 1 are supplied with water in the same manner as previously described and used for the radiation shielding.

In a case where the bags 1 in FIG. 19 are served for radiation shielding, since there is no effective water to shield radiation around the eyelet metal fasteners 3, it is necessary to obtain a radiation shielding function by the other means.

In the embodiment of FIG. 20, the three horizontal frames 43, 44, 45 perform the radiation shielding function. That is, the three horizontal frames 43, 44, 45 each are overlapped with portions of the bags 1, and the overlapped portion of each frame effect radiation shielding.

In particular, the middle horizontal frame 44 is made in wider in width than the other frames 43 and 45, and has a role to block gaps between the upper and lower bags 1 and prevent radiation from passing through the gaps.

In the embodiment of FIG. 20, even if the frame 40 is moved with the casters 40, or even if external force such as earthquake acts on the bags 1, since the bags 1 hooked on the frame 7 at the upper and lower portions, such a phenomenon does not occur that the bags 1 swing to form gaps between adjacent bags 1, and radiation shielding is surely effected.

After radiation shielding is finished, water in the bags 1 is discharged in the same manner as in the previously described embodiments to make the weight of them light and then the frame 7 and the bags 1 are removed.

The bag 1 of FIG. 19 has substantially the same weight and size as in the embodiment shown in FIG. 9, the total length L, the width W and the thickness are about 1 m, about 36 cm and about 5 cm, respectively in the attitude of the bags 1 being used for radiation shielding, whereby the weight of the bag 1 is made within about 0.5 kg and its handling is made easy. The bag 1 filled with water has a weight of about 17 kg.

What is claimed is:

1. A radiation shielding body unit comprising:

a bag;

a reinforcing wall connecting between inner wall surfaces of said bag opposite to each other;

a liquid supply/discharge port for radiation shielding liquid, provided in said bag; and a hole portion provided in said bag for engagement with a connection means used when said bag is supported by suspension.

2. A radiation shielding body unit according to claim 1, wherein said hole portion is provided at a liquid-tight portion formed by overlapping a plurality of opposite surfaces of said bag at an upper portion at least, and making the overlapped portion liquid-tight.

3. A radiation shielding body unit according to claim 2, wherein said liquid-tight hole portion is a portion in which a plurality of opposite surfaces of said bag liquid-tightly sandwich a metal plate.

4. A radiation shielding body comprising a frame and a plurality of said radiation shielding body units according to claim 2, each of said radiation shielding body units being supported by suspension by said frame through a connecting device engaged with said hole portion of each of said radiation shielding body units.

5. A radiation shielding body according to claim 4, wherein said plurality of radiation shielding body units are arranged in both a vertical direction and a horizontal direction.

6. A radiation shielding body according to claim 5, wherein said frame having a horizontal metal frame lapped with a gap or vertical spacing between said radiation shielding body units arranged in the vertical direction and said liquid-tight portion of each of said radiation shielding body units.

7. A radiation shielding body according to claim 6, wherein said radiation shielding body units arranged in the up and down direction are supported by suspension independently from each other by said frame.

8. A radiation shielding body unit according to claim 7, wherein a hole portion is made in a liquid-tight portion of each of said radiation shielding body units at a lower portion thereof, and said hole portion is connected to said frame.

9. A radiation shielding body according to claim 4, wherein a hole portion is provided in a liquid-tight portion of each of said radiation shielding body units at a lower end portion thereof, and horizontally adjacent radiation shielding body units are connected to each other by a connecting device passing through said hole portion at the lower end portion.

10. A radiation shielding body according to claim 4, wherein a hole is provided in said liquid-tight portion at a lower portion of each of the upper radiation shielding body units of said vertically adjacent radiation shielding body units, and each of said vertically adjacent radiation shielding body units is connected by a connecting device inserted in said hole made in said liquid-tight portion thereof.

11. A radiation shielding body according to claim 4, wherein said frame is provided with wheels, and movably supported by said wheels.

12. A radiation shielding body according to claim 11, wherein said bags each are made of resin sheet and flatten.

13. A radiation shielding body according to claim 4, wherein connecting devices are provided on said frame so as to be movable along said frame.

14. A radiation shielding body according to claim 13, wherein said bags each are made of resin sheet and flatten.

15. A radiation shielding body according to claim 4, wherein said bags each are made of resin sheet and flatten.

16. A radiation shielding body unit according to claim 1, wherein said bag is made of resin sheet and flatten.

17. A radiation shielding body comprising:

a frame having at least one support column standing vertically and at least two horizontal frames vertically spaced from each other and connected to said support column;

connecting devices mounted on each of said horizontal frames at intervals in the horizontal direction;

a plurality of bags, each reinforced by a reinforcing wall connecting opposite inner wall surfaces thereof and containing therein radiation shielding water, each of said bag provided with a supply/discharge port for the radiation shielding water; and a radiation shielding member of metal provided at the height at which said radiation shielding member laps with a gas between said bags vertically adjacently arranged.

18. A radiation shielding body according to claim 17, wherein lower one of said at least two horizontal frames, positioned at a lower side is made of metal, and said radiation shielding member is said lower horizontal frame the width of which is extended so as to lap with said gap between said vertically adjacent bags, said width being in the vertical direction.

19. A radiation shielding body according to claim 18, wherein said frame has wheels movably supporting said frame.

* * * * *